US005172640A

United States Patent [19]

Cathiard

[11] Patent Number: 5,172,640

[45] Date of Patent: Dec. 22, 1992

[54] OVERHEAD CABLE TRANSPORT INSTALLATION HAVING TWO SUCCESSIVE SECTIONS

[75] Inventor: Jean-Pierre Cathiard, Noyarey, France

[73] Assignee: Pomagalski S.A., France

[21] Appl. No.: 801,464

[22] Filed: Dec. 2, 1991

[30] Foreign Application Priority Data

Dec. 18, 1990 [FR] France ..... 90 15985

[51] Int. Cl.[5] ..... B61B 11/00

[52] U.S. Cl. ..... 104/173.2; 104/178; 104/184; 104/191; 104/197; 104/196

[58] Field of Search ..... 104/173.1, 184, 173.2, 104/178, 180, 185, 189, 192, 191, 197, 196

[56] References Cited

U.S. PATENT DOCUMENTS

| | | | |
|---|---|---|---|
| 4,401,034 | 8/1983 | Gaudet | 104/178 |
| 4,470,355 | 9/1984 | Kunezynski | 104/117 |
| 4,669,389 | 6/1987 | Tarassoff | 104/178 |
| 4,942,823 | 7/1990 | Meindl | 104/178 |

*Primary Examiner*—George E. A. Halvosa
*Assistant Examiner*—Mark T. Le
*Attorney, Agent, or Firm*—Parkhurst, Wendel & Rossi

[57] ABSTRACT

The hauling-carrier cable of a gondola lift or chair lift is subdivided in two endless cable loops operating together. These cable loops are linked by a technical relay including two bull wheels or a bull wheel with two grooves, one for each cable loop. Transfer rails located in the technical relay permit the passage of the cabins from one cable loop to the other. The cabins, uncoupled from the cable, run on the transfer rail at the same velocity as the cable. The two bull wheels are mechanically coupled to transfer the driving power from one cable loop to the other.

7 Claims, 5 Drawing Sheets

OVERHEAD CABLE TRANSPORT INSTALLATION HAVING TWO SUCCESSIVE SECTIONS

BACKGROUND OF THE INVENTION

The invention relates to an overhead cable transport installation, especially a gondola lift or a chair lift, running continuously in a closed circuit between a starting station and an arrival station. Loads, such as gondolas, cabins or chairs, supported by carriages, are coupled with the cable on the circuit and de-coupled or released from the travelling cable at the stations. The carriages travel through the station on a half-loop circuit linking the up and down tracks before being reattached to the cable as they leave the station. The travelling circuit for the loads in the station comprises a deceleration section, having carriage braking means, a disembarking and/or embarking section or sections and an acceleration section, having drive means to increase the travel velocity of the loads. Further there are provided conveyors for driving the carriages along this half-loop circuit and the equipment of such a station is quite complicated and expensive. Overhead cable transport installations of this type have a high conveying capacity, due to the large number of loads continuously running on the closed circuit. Such installations, for instance, are described in the U.S. Pat. No. 4,627,361, and are well known.

In the case of overhead cable transport installations having an arrival station at a much higher level, such as at the top of a mountain, than the starting station, such as at the base of the mountain, and having a high carrying capacity, the tension forces in the cable may become excessive. These forces may result in the necessity of using a cable having a relatively large diameter.

It is an object of the present invention to provide an overhead cable transport installation which will utilize a cable having a diameter within a desirable range for economical operation.

Another object is to provide an installation having a high transport capacity and a high regular travel velocity of the loads along the whole track.

SUMMARY OF THE INVENTION

The installation according to the invention comprises a technical relay located up along the mountain between the two end stations and having two bull wheels. A first endless cable loop extends between the first end station, for instance the starting station, and the technical relay and a second endless cable loop extends between the technical relay and the second, for instance the arrival station. The technical relay does not comprise a half loop circuit, but it comprises two straight transfer or connecting rails or tracks joining the first and the second cable loops respectively on the up track side and on the down track side. The installation comprises two successive sections, each having an endless cable loop, which are joined by the technical relay. The carriages, upon entering the technical relay, are detached from the cable and pass from one section to the other on both the up and down tracks. At the exit from the technical relay, the carriages are coupled to the cable of the following section. The technical relay includes two return bull wheels or a bull wheel having two superposed grooves, whereupon the cable of the first section and the cable of the second section run.

It is clear that the two sections operate together and that the length and the denivelation of each section are the half or a part of those of the installation. The addition of a technical relay permits a reduction of the cable diameter and does not involve other modifications of the installation.

In U.S. Pat. No. 4,669,389 an overhead cable transport installation has two sections connected in series by an intermediate station constituted by the arrival station of the first section and the starting station of the second section. Each section can operate independently one from the other, the passengers embarking and disembarking in the intermediate station. The sections can also be connected in series to transfer the carriages from one section to the next. In this prior art installation the intermediate station is still more complicated than an end station and the object of the intermediate station is not the same as the object of the technical relay of the present invention.

In U.S. Pat. No. 4,401,034 a material transport installation comprises a plurality of successive sections for conveying materials over long distances, for instance of more than ten kilometers, each section having its own cable loop and drive motor. The length of the cable is thus reduced and at the intermediate points along the conveyor and between two sections, materials may be stocked in order to prevent the stopping of the whole installation when one section must be stopped. The intermediate points are two quite complicated adjacent stations.

The technical relay according to the present invention does not include passengers disembarking and embarking sections in the technical relay. Also, it is not necessary to reduce the travel velocity of the carriages in the technical relay. In that case, the technical relay does not need carriages accelerating and decelerating means and the passage through the technical relay without any speed reduction is more comfortable and faster.

The two endless cable loops are advantageously driven by the same motor, for instance located in the starting station and coupled to the end wheel of the first cable loop. The two bull wheels in the technical relay are mechanically coupled for transferring the driving power from the first cable loop to the second cable loop. The two bull wheels may be superposed on a same vertical axis or constituted by a wheel having two superposed grooves. The bull wheels may also be spaced apart in the direction of the track and coupled by a mechanical transmission.

Each section can include a cable tensioning apparatus, but it is advantageous to employ the same cable tensioning apparatus for the two cable loops by mounting the bull wheels of the technical relay to a movable carriage, which in turn is mounted for reciprocal motion on carriage guide means in a direction of the track. The movable carriage is driven by a tension take up hydraulic or pneumatic cylinder.

The transfer rails of the technical relay extend advantageously straight in the direction of the up and down tracks and the two bull wheels are offset downwards to permit the passage of the carriages which run on the transfer rails. The transfer rails have each operatively associated therewith carriage driving means such as sets of friction wheels arranged in succession in the direction of movement of the carriages so as to frictionally engage a friction plate rigidly connected to the carriage. The friction wheels, in particular pneumatic wheels, are operatively connected to the bull wheels or to the cable so that their circumferential velocity is equal to the travel velocity of the cable and so that the technical relay does not need a special power supply.

BRIEF DESCRIPTION OF THE DRAWINGS

The attached drawings show by way of example various embodiments of the present invention in which.

BRIEF DESCRIPTION OF THE PREFERRED EMBODIMENTS

In the Figures the same reference numbers are used to designate identical or similar parts.

Figure 1:
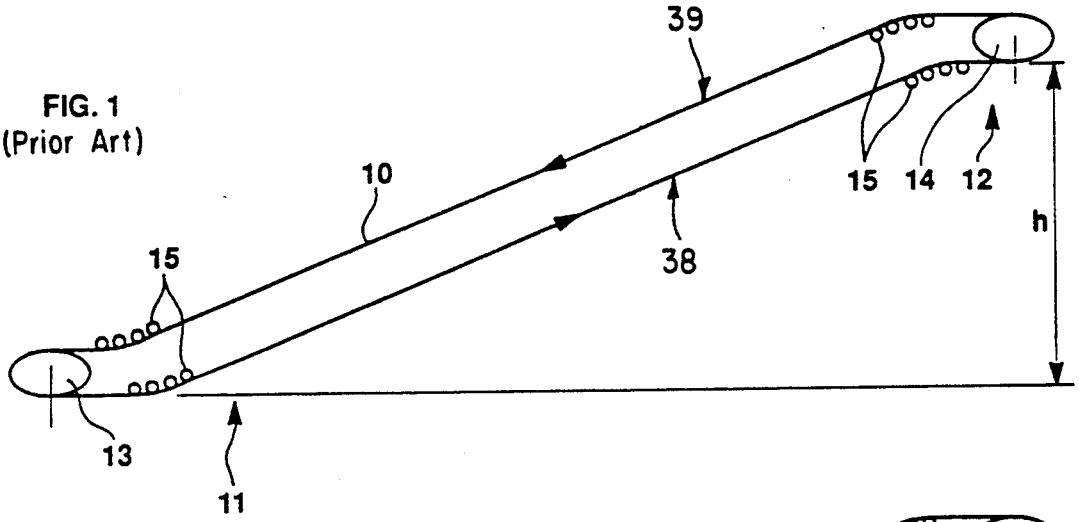
FIG. 1 (Prior Art)
FIG. 1 is a general perspective view of a prior art overhead cable transport installation.

In the FIG. 1, an overhead cable transport installation, for example, a single cable detachable gondola lift or chair lift, comprises a hauling-carrier cable 10, extending in a closed loop between two uphill and downhill stations 11,12, running on return end wheels 13,14 and along an up track 38 and a down track 39. The cable 10 is supported by sheaves 15 mounted on towers P. The loads, particularly cabins or chairs 17, hereafter cabins, are each fixed by a hanger arm 41 to a carriage 16 bearing a grip 33 coupling it to the cable 10. The carriage 16 has rollers 42 and a drive plate 43 cooperating with friction drive sheaves 28.

At the entry 36 to the station, a half loop rail 40 on which the rollers 42 engage is disposed parallel to the rope 10 and a ramp opens the grip 33 to uncouple the carriage 16 from the cable 10. The friction drive sheaves 28 cooperate with the plate 43 of the carriage to drive the latter. The sheaves 28 decelerate along a section 34 the carriage 16 detached from the cable 10, drive the carriage on the rail 40 and accelerate it along a section 35 for coupling to the cable 10 at the station exit 37. The carriage 16 passes on embarking and/or disembarking areas 45 and a wheel 46 drives the carriage along the curved rail section 40. Such a gondola lift or chair lift is well known and the size, particularly the diameter of the cable 10 is determined essentially in function of the height difference or difference of level "h" between the uphill and the downhill stations 11,12 and the load, namely the weight and the number of cabins.

According to the invention the cable 10 is subdivided in two endless cable loops 18,19, a first cable loop 18 extending between the first downhill station 11 and a technical relay 20 and a second cable loop 19 extending between the technical relay 20 and the second uphill station 12. The technical relay 20 has two bull wheels 21,22 whereon the cable loops 18 and 19 pass respectively. It is clear that the height difference for each cable loop 18,19 is only a part or the half of that "h" of the prior art installation shown on FIG. 1 and that the cable diameter may thus be reduced.

The technical relay 20 has two transfer rails 23,24 linking the two cable loops 18,19 and grip control devices detaching the carriage 16 from one cable loop upon entering of the technical relay 20 and coupling the carriage 16 on the other cable loop at the exit in a well known manner for intermediate stations.

Figure 2:
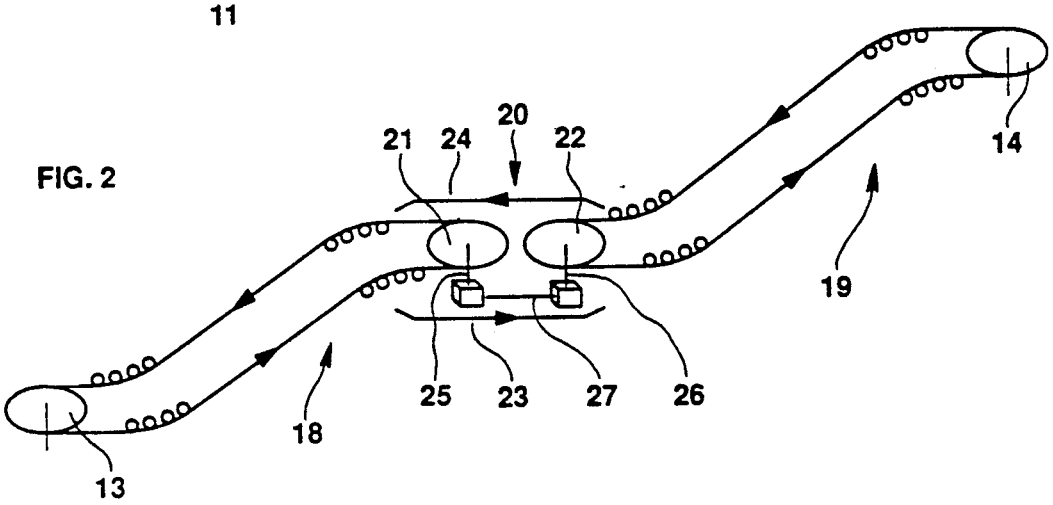
FIG. 2 is a view similar to FIG. 1 of an installation according to the present invention.
Figure 3:
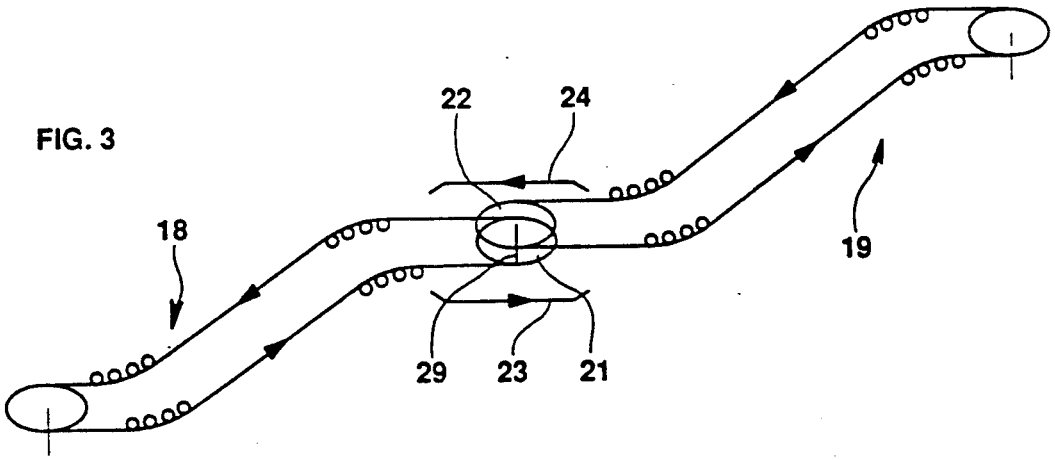
FIG. 3 is a view similar to FIG. 2, illustrating an alternative embodiment.
Figure 4:
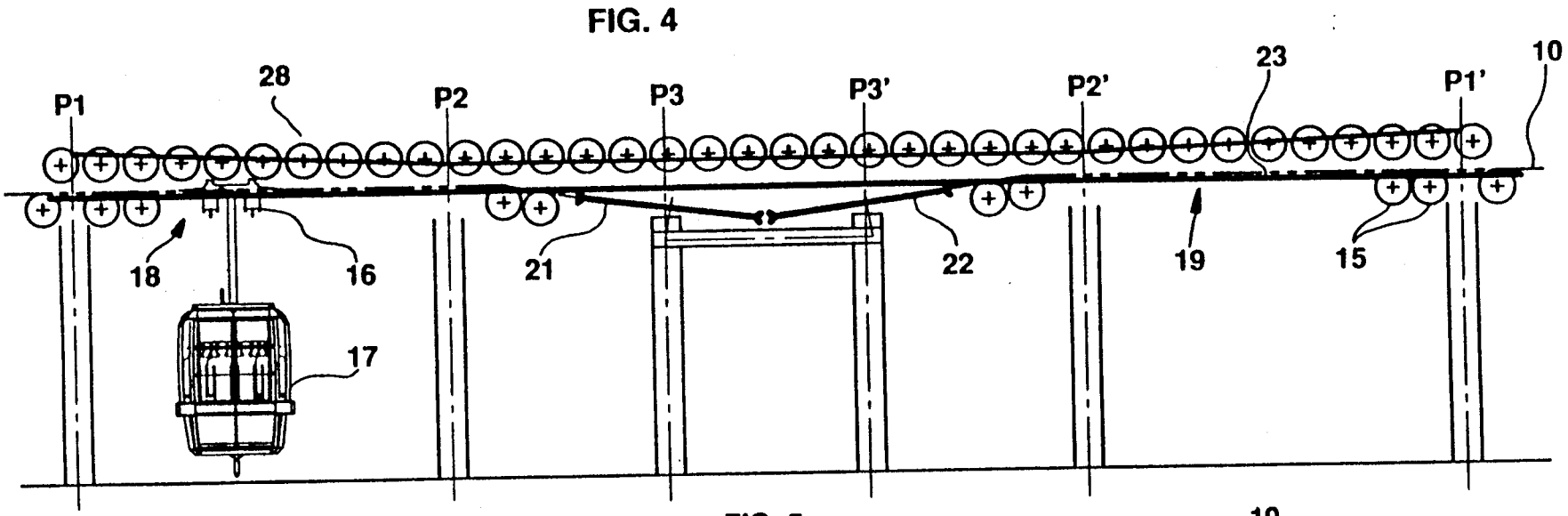
FIG. 4 is a schematic elevational view of the technical relay.
Figure 5:
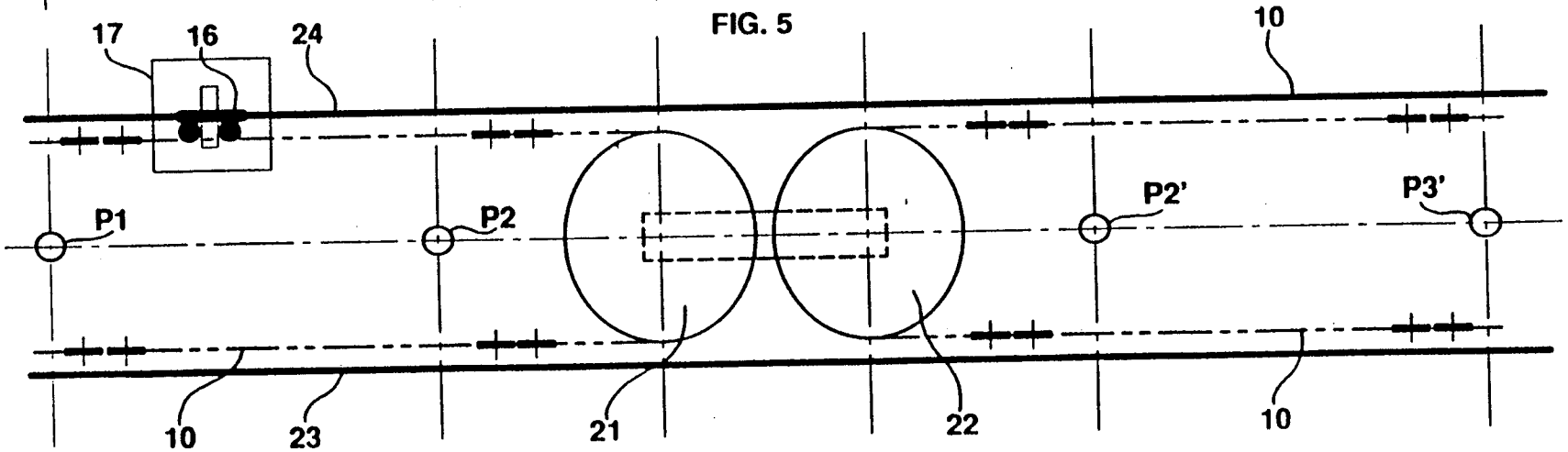
FIG. 5 is a plan view of the technical relay according to FIG. 4.

In FIGS. 2,4 and 5 the bull wheels 21,22 are disposed one after the other in the track direction and their axes 25,26 are coupled by a power transmission shaft 27 so as to rotate at the same speed and in the same direction. The installation is driven by a motor 47 coupled to one of the end wheels 13,14, for instance located at the starting station, for driving one of the cable loops 18,19, and the movement is transferred to the other cable loop by the transmission shaft 27. As will be readily appreciated, other structures can be employed for driving the cable loops 18,19. Thus, a drive motor can be coupled to each end wheel 13,14 and the speed of the two cable loops 18,19 may be synchronized by means of electronic control systems.

In FIGS. 4 and 5 the bull wheels 21,22 are supported by towers P3,P3' and are offset downwards such that the transfer rails 23,24 extend straight in the track direction. The bull wheel axes 25,26 are slightly inclined to free the passage for the carriages 16, and sheaves 15 guide the cable towards the bull wheels 21,22.

The transfer rails 23,24, supported by towers P1,P2,P1',P2', are equipped with sets of friction sheaves, here pneumatic wheels 28, which frictionally contact the drive plates 43 to drive the uncoupled carriages 16 along the transfer rails 23,24. The pneumatic sheaves 28 are driven in the same manner as in the stations 11,12, by a transmission shaft connected to the bull wheels 21,22 or directly to the cable loops 18,19 so as to possess rotational speeds which are equal to the velocity of the cable. Thus the cabins 17 are not decelerated in the technical relay 20 and their speed remains the same along the whole track.

Figure 6:
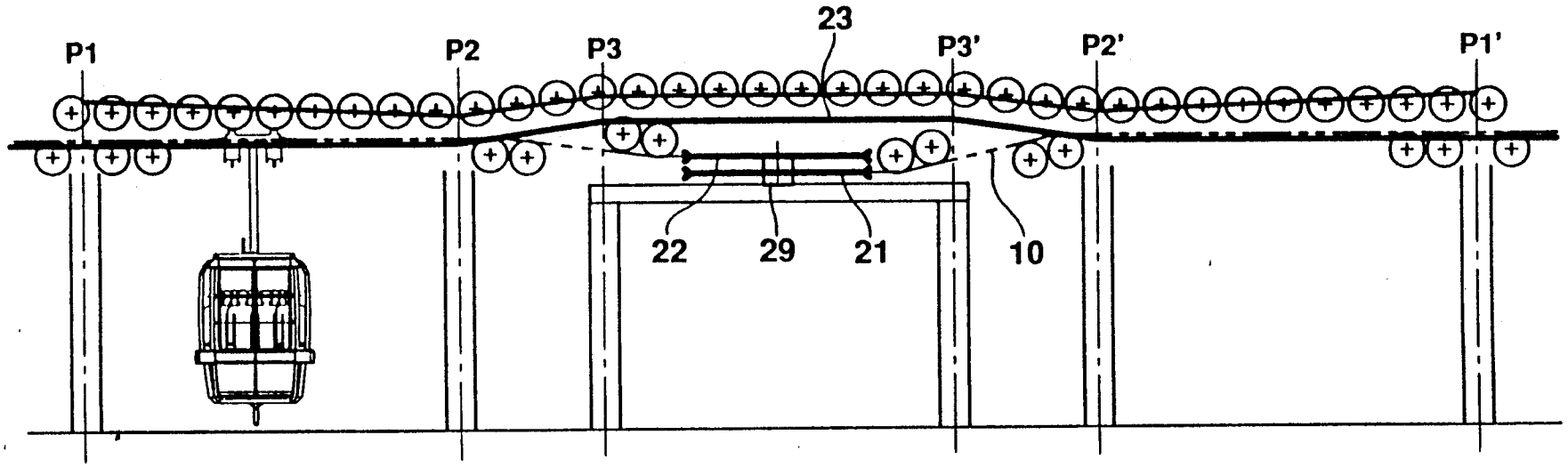
FIGS. 6 and 7 are similar views to those of FIGS. 4 and 5, showing an alternative embodiment.
Figure 7:
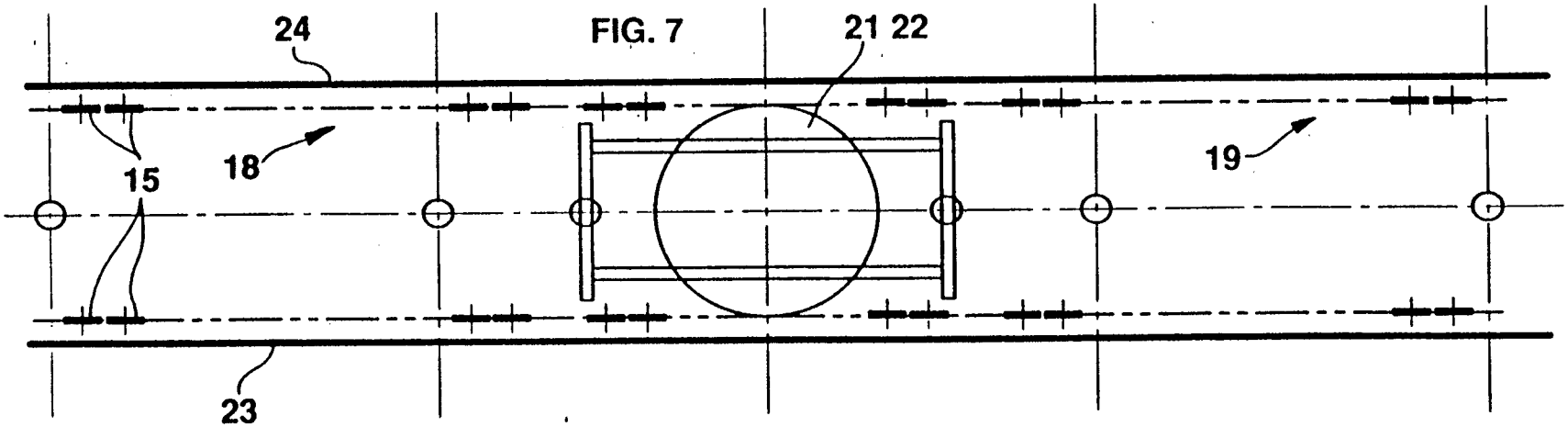
Figure 8:
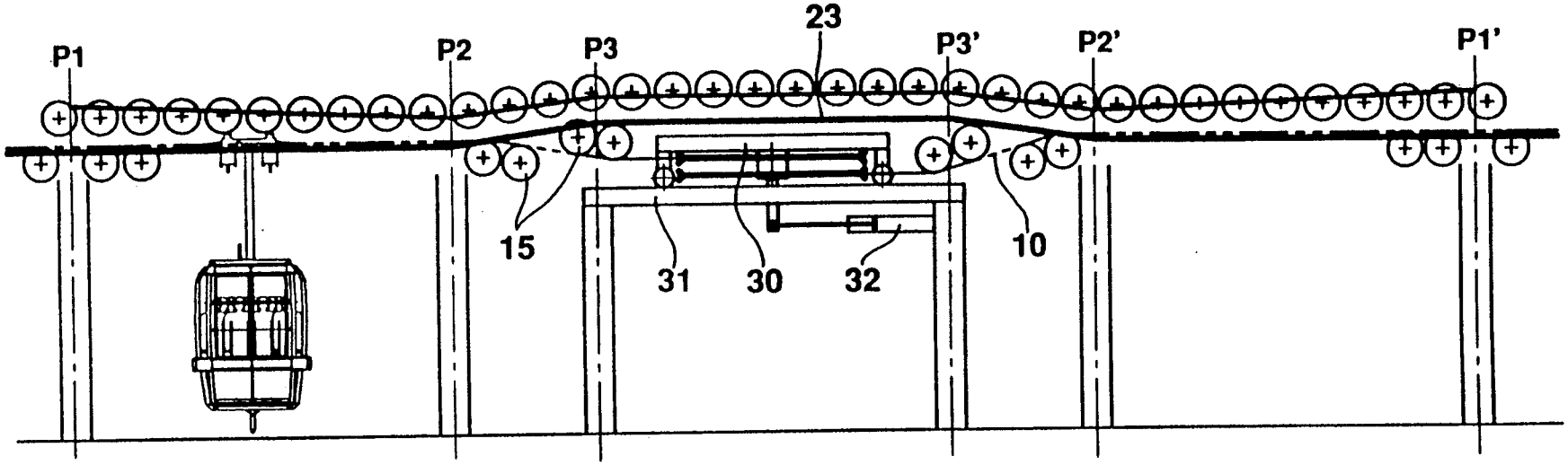
FIGS. 8 and 9, similar to FIGS. 6 and 7 show another alternative embodiment.

As will be seen by referring to FIGS. 3, 6–8 the bull wheels 21,22 can be mounted on the same vertical axis 29 or can be a single bull wheel having two superposed grooves, each associated to one of the cable loops 18,19. As in the previously described arrangement, the bull wheels 21,22 can be offset downwards so that the transfer rails 23,24 and the cable loops 18,19 are located substantially in the same plane. Alternatively, the bull wheels 21,22 are at the level of the cable loops 18,19 and the transfer rails 23,24 are deviated upwards to pass over the bull wheels 21,22. As shown in FIGS. 6–8 the bull wheels 21,22 can be shifted slightly downwards and the transfer rails 23,24 are deviated slightly upwards.

Figure 9:
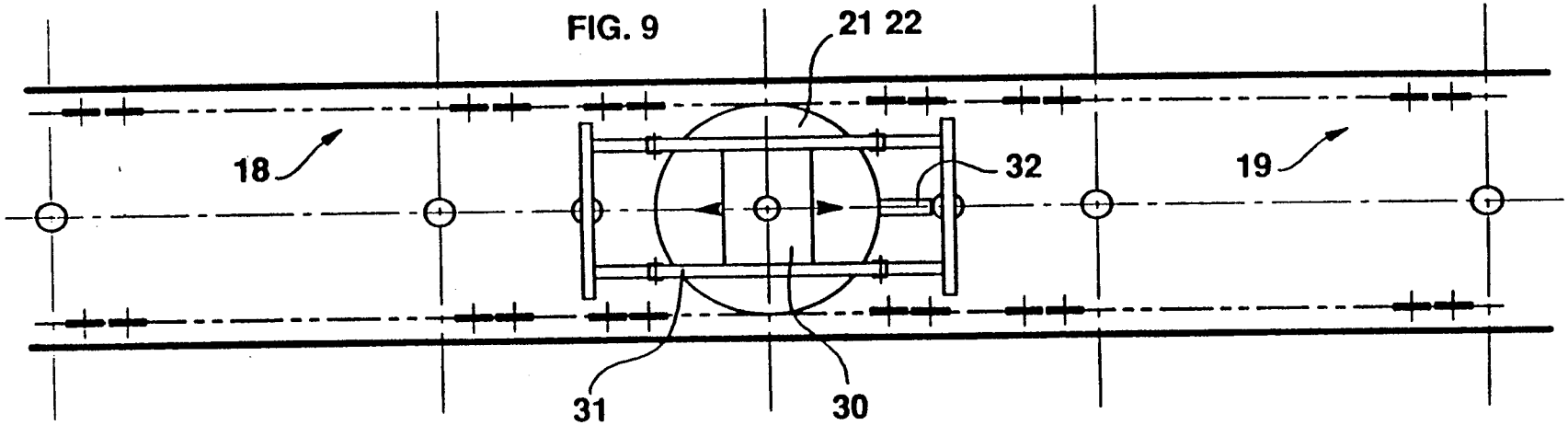
Figure 10:
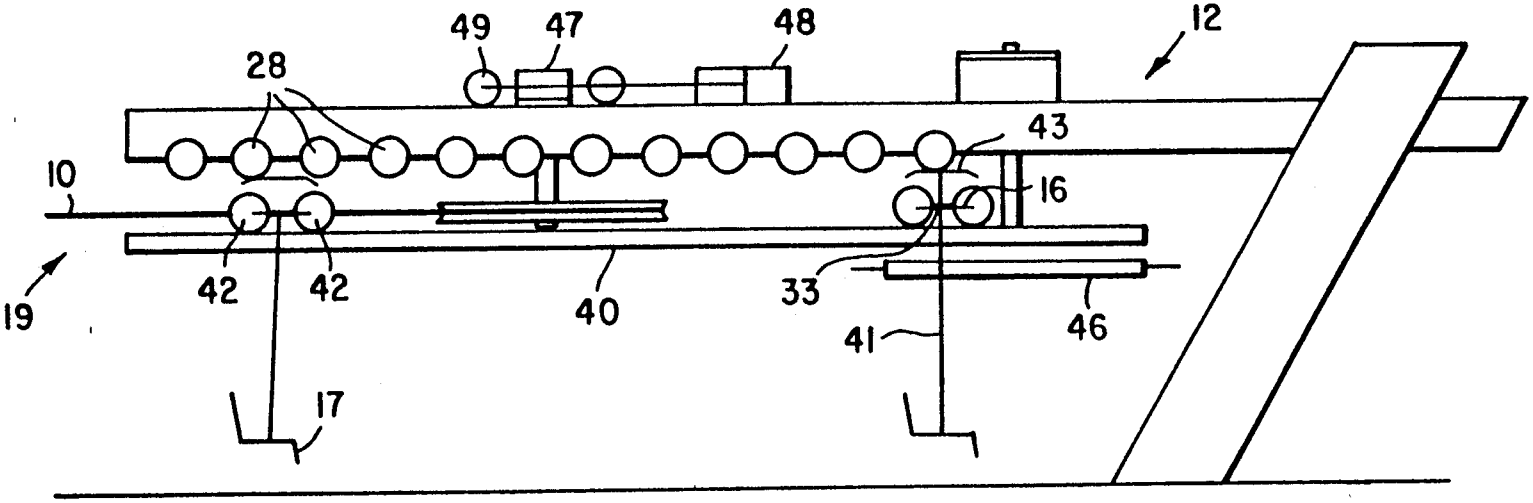
FIG. 10 is a schematic elevational view of an end station according to the invention.
Figure 11:
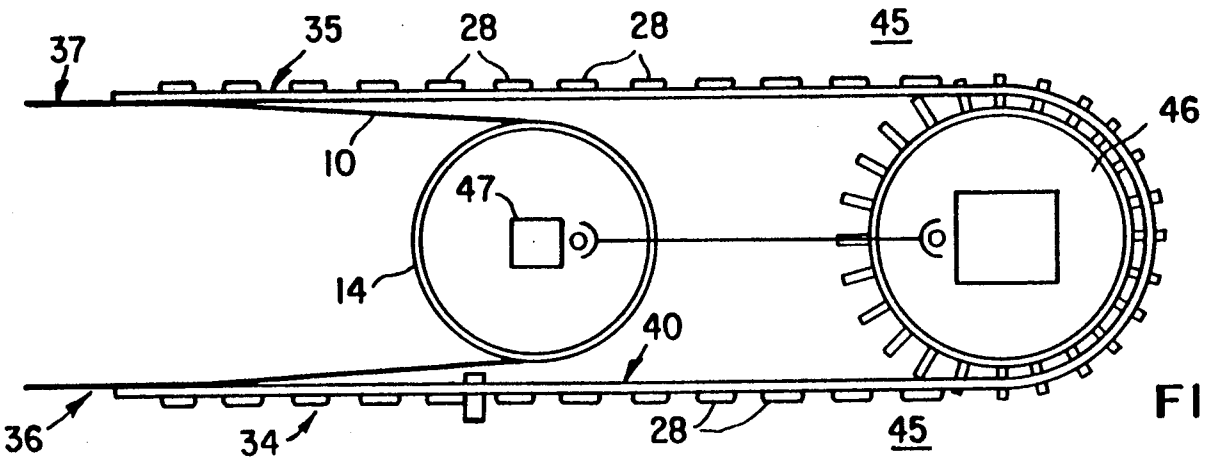
FIG. 11 is a plan view of the end station according to FIG. 10.

Each cable loop 18,19 can be provided with its own cable tensioning device located in the end station 11,12 and comprising for instance a counterweight or a cylinder-piston jack 48 operatively coupled to a movable carriage 49 whereon the end wheel 14 is mounted in that case the two bull wheels 21,22 are stationary. FIGS. 8,9 represent an alternative embodiment in which only one end station, for instance the arrival station 12, comprises a cable tensioning device 48. In order to transfer the tension force to the other cable loop 18, bull wheels 21,22 are mounted to a movable carriage 30 which is mounted for reciprocal motion on rails 31 in a direction of the track. The rails 31 are supported by towers P3,P3' and a cylinder-piston jack 32 is coupled to carriage 30 for displacement thereof in the direction of the cable loop 19 equipped with the cable tensioning device 48. The jack 32 takes up a part of the tension forces.

The technical relay according to the invention operates as follows:

At the entrance of the technical relay 20, the carriage 16 of a cabin 17 coupled to the cable loop 18 runs on the transfer rail 23 and its grip is opened to uncouple the carriage 16 from this cable loop 18. The carriage 16 is driven by the pneumatic sheaves 28 at a speed corresponding to the velocity of the cable. At the exit of the technical relay 20 the carriage 16 is coupled to the cable loop 19. In the same manner, the cabins on the down track run on the other transfer rail 24 on the passage of the technical relay 20. The cabins are not braked or accelerated in the technical relay 20 and they follow a straight trajectory without any oscillation or shock. It is clear that the technical relay 20 needs only conventional parts and is not complicated in its design. It can be supported by towers and can be located at the middle of the track or on any other point. In a simplifed installation the transfer rails 23,24 may be inclined and the carriages 16 are driven by their own weight so that the friction sheaves 28 can be omitted.

What is claimed is:

1. A closed loop overhead cable transport, comprising:

first and second end stations comprising first and second end wheels, respectively, each end station including an entrance and an exit;

up and down tracks connecting said first and second end stations;

a technical relay disposed between said first and second end stations, said technical relay comprising first and second bull wheels;

a first closed loop cable connecting said first bull wheel to said first end wheel of said first end station, and a second closed loop cable connecting said second bull wheel to said second end wheel of said second end station;

loads for running along said first and second closed loop cables;

carriages supporting said loads, said carriages having detachable grips for coupling and de-coupling said carriages from said first and second closed loop cables upon entering and exiting one of said first and second end stations;

a half loop circuit along which said carriages run while being de-coupled from said first and second closed loop cables in said first and second end stations;

carriage acceleration and deceleration zones at the exit and entrance, respectively, of said first and second end stations;

passenger embarking and disembarking sections located between said acceleration and deceleration zones in said first and second end stations;

up and down transfer rails provided in said technical relay linking said first and second closed loop cables to each other along said up and down tracks, respectively;

a drive motor coupled to one of said first and second end wheels directly to drive one of said first and second closed loop cables; and mechanical coupling means coupling said first and second bull wheels such that the other of said first and second closed loop cables is driven indirectly by said drive motor via said one of said first and second closed loop cables, wherein said carriages are de-coupled from said first and second closed loop cables upon entering said technical relay, said first and second carriages being driven along said up and down transfer rails at a speed substantially corresponding to a speed of said first and second closed loop cables, said carriages being coupled to said first and second closed loop cables upon exiting the technical relay.

2. The transport of claim 1, wherein said first and second bull wheels are provided along the same vertical axis.

3. The transport of claim 1, wherein said first and second bull wheels are disposed adjacent to each other in a direction of said up and down tracks.

4. The transport of claim 1, wherein said technical relay further comprises friction sheaves spaced along said up and down transfer rails for driving said carriages while running along said up and down transfer rails.

5. The transport of claim 1, further comprising cable tensioning means cooperating with one of said first and second end wheels to tension one of said first and second closed loop cables, and tensioning transfer means located in said technical relay for transferring tension to the other of said first and second closed loop cables.

6. The transport of claim 5, wherein said first and second bull wheels are coupled to a movable carriage, and wherein said tensioning transfer means comprises a piston and a cylinder jack to displace said movable carriage in a direction causing tensioning of said other of said first and second closed loop cables.

7. The transport of claim 1, further comprising towers supporting the technical relay.

* * * * *